US005392544A

United States Patent [19]

Price

[11] Patent Number: 5,392,544

[45] Date of Patent: Feb. 28, 1995

[54] WALL MOUNTED CARD HOLDER

[76] Inventor: Gordon B. Price, 6 Lambton Court, Brampton, Ontario, Canada, L6V 2A9

[21] Appl. No.: 750,277

[22] Filed: Aug. 27, 1991

[51] Int. Cl.[6] ..... A47G 1/16

[52] U.S. Cl. ..... 40/152; 40/616

[58] Field of Search ..... 40/152, 152.1, 158.1, 40/630, 124.5, 158, 160, 124.5, 657, 618, 124; 428/195, 13, 27, 413

[56] References Cited

U.S. PATENT DOCUMENTS

| | | | |
|---|---|---|---|
| 1,875,721 | 9/1932 | Frost | 40/615 |
| 2,747,311 | 5/1956 | Fulmer | 40/156 |
| 3,371,439 | 3/1968 | Smith et al. | 40/156 |
| 3,407,523 | 10/1968 | Winston | 40/1.5 |
| 3,445,151 | 5/1969 | Stefanakis | 350/67 |
| 3,517,452 | 6/1979 | Finley et al. | 40/159 |
| 3,532,209 | 10/1970 | Benis | 40/152.1 |
| 3,786,584 | 1/1974 | Holson | 40/124 |
| 3,965,594 | 6/1976 | Candor | 40/152 |
| 4,125,655 | 11/1978 | Kanzelberger | 40/616 |
| 4,164,085 | 8/1979 | Steeb et al. | 40/152 |
| 4,165,573 | 8/1979 | Richards | 40/10 |
| 4,333,253 | 6/9182 | Cooper | 40/152 |
| 4,510,707 | 4/1985 | Girard | 40/152 |
| 4,534,185 | 8/1985 | Berry et al. | 63/1 |
| 4,779,368 | 10/1988 | Thede | 40/152 |
| 4,860,468 | 8/1989 | Cliborn | 40/124 |
| 4,933,218 | 6/1990 | Longobardi | 40/615 |
| 4,979,619 | 12/1990 | Hager | 206/509 |
| 5,010,672 | 4/1991 | Coleman | 428/13 |

*Primary Examiner*—Peter R. Brown
*Assistant Examiner*—Cassandra Davis
*Attorney, Agent, or Firm*—Baker & Daniels

[57] ABSTRACT

There is provided a wall mounted card holder for permanently mounting a card or photograph in addition to temporarily holding and displaying other cards, photographs and the like. The holder includes a decorative wood panel backing having a transparent, hard protective coating applied to the front face thereof. The coating is preferably an epoxy resin applied in liquid form which hardens within a preset period of time. A card holder is mounted on the front face of the panel and includes a planar backing plate bonded to the protective layer and a transparent front cover matched to the backing plate and which snaps thereonto. A card or photograph may be permanently embedded into the epoxy after application of the latter to the front face and prior to same setting in order to permanently display the card adjacent the temporarily displayed cards.

8 Claims, 2 Drawing Sheets

WALL MOUNTED CARD HOLDER

FIELD OF THE INVENTION

The present invention relates to display plaques for temporarily displaying cards, photographs and the like.

BACKGROUND OF THE INVENTION

There are many devices in the prior art used for displaying cards and photographs. Some of these devices use magnetic retaining members for holding sheets to a magnetic metal backing while other devices include a raised portion located on a backing plate wherein a card is retained against the raised portion using clips and the like. Other card displaying devices employ multiple plastic panels which fit together and when assembled provide holding slots for the cards. It would be advantageous to provide a card display system which provides an aethsetically pleasing display which allows for permanent and temporary display of cards.

SUMMARY OF THE INVENTION

The subject invention provides a card holder for temporarily mounting cards or photographs for display. In one aspect of the invention, a card holder includes a backing member having a front face, a hard, transparent protective coating covering the backing member, and at least one card receiving means bonded to the coating on the front face of said backing member. The card receiving means is smaller than the backing member and comprises a planar backing plate bonded to the coating. This backing plate is dimensioned to extend the height and width of a card to be placed thereon. The card receiving means includes a detachable, transparent front cover wherein a card to be displayed is receivable between the backing plate and the transparent cover.

According to another aspect of the invention, a display panel for displaying cards and pictures comprises a backing member having a front face; a hard, transparent protective coating covering said backing member; at least one card or picture receiving means bonded to said coating on the front face of said backing member, said receiving means being smaller than the backing member, and including a detachable, transparent cover, said receiving means adapted to receive a card or picture between said front face and said transparent cover; and at least one card or picture permanently mounted between said protective coating and the backing member on the front face thereof at a position adjacent said receiving means.

According to a further aspect of the invention, a display panel for displaying cards or pictures comprises a backing member having a front face; a hard, transparent protective coating covering said backing member; and at least one card or picture receiving means bonded to said coating on the front face of said backing member, said receiving means being smaller than the backing member, and including a detachable, transparent cover, said receiving means adapted to receive a card or picture between said front face and said transparent cover; wherein the protective coating is a two component epoxy resin which, when said components are mixed, sets and hardens within a predetermined period of time.

BRIEF DESCRIPTION OF THE DRAWINGS

Preferred and alternative embodiments of the invention will now be described by way of example only, with reference to the following drawings, in which:

FIG. 3 is a cross-sectional view along lines 2—2 of FIG. 1 of a further embodiment of a wall mounted card holder according to the present invention.

DETAILED DESCRIPTION OF THE PREFERRED EMBODIMENTS

Figure 1:
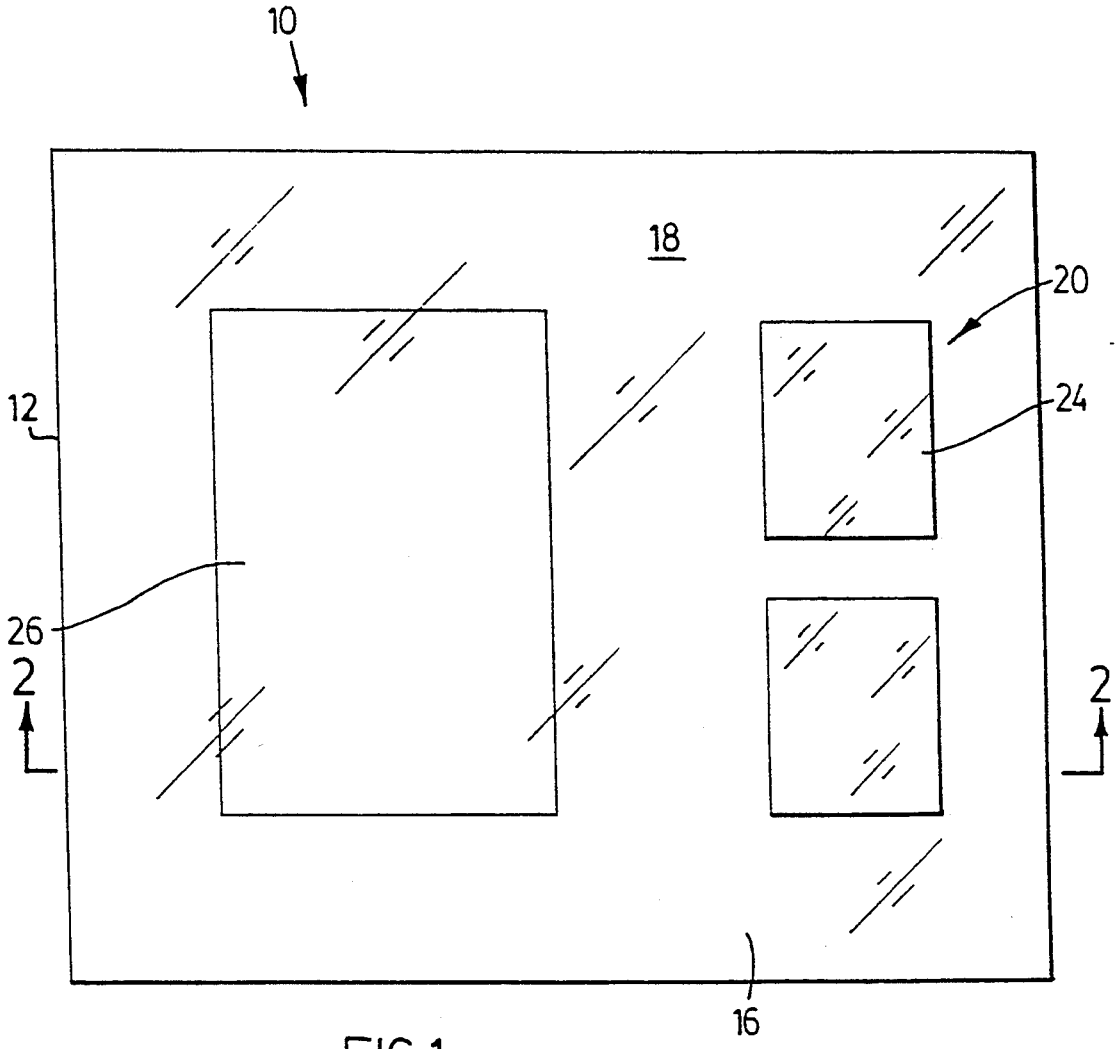
FIG. 1 is a top view of a wall mounted card holder according to the present invention.
Figure 2:
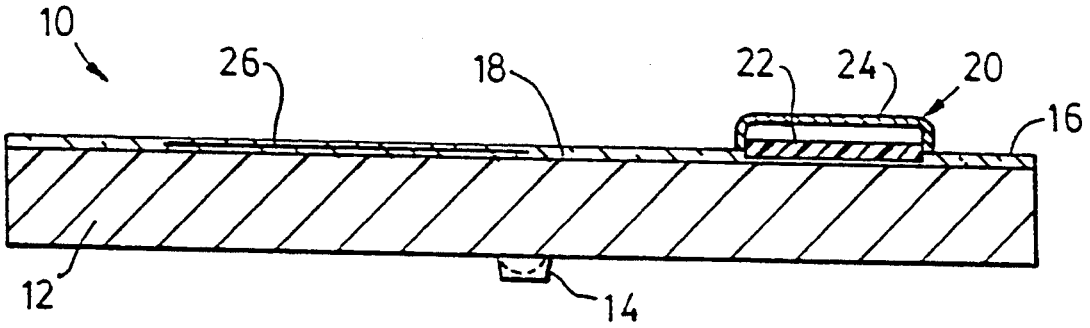
FIG. 2 is a cross-sectional view along line 2—2 of FIG. 1 of a wall mounted card holder according to the present invention.
Figure 3:
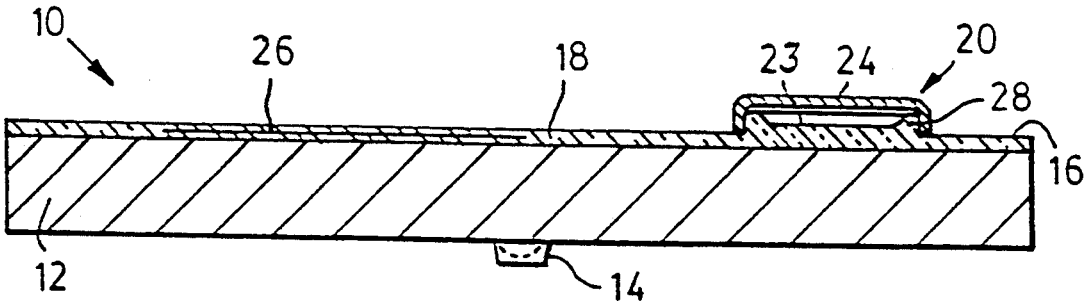
FIG. 3 is a cross-sectional view along lines 2—2 of FIG. 1 of an alternative embodiment of a wall mounted card holder according to the present invention.

A card display mount for temporarily displaying cards is shown generally at 10 and includes a backing member 12 preferably fabricated from a decorative wood panel. This panel may for example be fabricated by burning patterns into the surface of a plywood panel. On the back face of member 12 is a wall hanging hook 14 which is of known design provided so that mount 10 may be wall hung if desired.

On the front face 16 of backing member 12 there is applied a protective transparent coating 18. Coating 18 its preferably a known epoxy resin comprising two components which are mixed and applied as a liquid to front face 16, whereupon the resin sets and hardens to form protective layer 18.

Prior to the resin hardening and while it is still tacky, a card receiving means shown generally at 20 is bonded to front face 16. Card receiving means 20 is of known design and preferably comprises a planar backing plate 22 which is embedded in the resin before it sets. The backing plate is demensioned to extend the height and width of a card to be placed thereon. Card receiving means 20 includes a detachable, transparent cover plate 24 which is engagably receivable by backing plate 22. The card to be displayed is placed between the backing plate and the cover plate. In an alternative embodiment, the card receiving means could be fabricated by forming a raised platform portion from the epoxy which is rectangular in shape and having a sharp edge, which may be further raised above the rest of the platform to form raised side walls 28, the raised portion formed using a mould. This raised portion would be slightly larger than cover 24, wherein the latter would include a peripheral edge extending transversely with respect to the planar portion thereof so that when the cover is pressed onto the raised portion, it snaps into place raised onto the raised side wall 28 at each edge of raised platform portion 23.

In one embodiment of the card holder, a card or photograph may be embedded in layer 18 or between layer 18 and backing 12. This may be achieved by placing card 26 on backing 12 in the desired position and covering same with coating 18, or alternatively by first covering panel 12 with coating 18, embedding card 26 in the uncured transparent coating 18 and then applying another layer of coating 18 on top of card 26.

The card holder may also be provided with a decorative frame (not shown) peripherally disposed about the perimeter of panel 12.

While the present invention has been described and illustrated with respect to the preferred and alternative embodiments, it will be appreciated that numerous variations of these embodiments may be made without departing from the scope of the invention, which is defined in the appended claims.

I claim:

1. A display panel for displaying cards or pictures, comprising:

a) a backing member having a front face;

b) a hard, transparent protective coating covering said backing member; and c) at least one card or picture receiving means bonded to said coating on the front face of said backing member, said receiving means being smaller than the backing member and comprising a planar backing plate bonded to said coating, said backing plate adapted to extend the height and width of a card or picture to be placed thereon, and a detachable, transparent cover engagably receivable by said backing plate, said receiving means being adapted to receive a card or picture between said backing plate and said transparent cover.

2. A display panel according to claim 1 wherein the backing member is a decorative wood panel, and further comprising mounting means attached to said backing member for mounting said display panel on a wall.

3. A display panel according to claim 1 wherein the receiving means is embedded in the protective coating and is thereby bonded to the backing member.

4. A display panel for displaying cards or pictures, comprising:

a) a backing member having a front face;

b) a hard, transparent protective coating covering said backing member;

c) at least one card or picture receiving means bonded to said coating on the front face of said backing member, said receiving means being smaller than the backing member, and including a detachable, transparent cover, said receiving means adapted to receive a card or picture between said front face and said transparent cover; and d) at least one card or picture permanently mounted between said protective coating and the backing member on the front face thereof at a position adjacent said receiving means.

5. A display panel according to claim 4 including two of said card receiving means mounted on said backing member.

6. A display panel for displaying cards or pictures, comprising:

a) a backing member having a front face;

b) a hard, transparent protective coating covering said backing member; and c) at least one card or picture receiving means bonded to said coating on the front face of said backing member, said receiving means being smaller than the backing member, and including a detachable, transparent cover, said receiving means adapted to receive a card or picture between said front face and said transparent cover;

d) wherein the protective coating is a two component epoxy resin which, when said components are mixed, sets and hardens within a predetermined period of time.

7. A display panel for displaying cards or pictures, comprising:

(a) a backing member having a front face;

(b) a hard, transparent protective coating covering said backing member;

(c) at least one card or picture receiving means located on said coating on the front face of said backing member, said receiving means being smaller than the backing member, and including a detachable, transparent cover, said receiving means adapted to receive a card or picture between said front face and said transparent cover; and (d) at least one card or picture permanently mounted between said protective coating and the backing member on the front face thereof at a position adjacent to said receiving means.

8. A display panel according to claim 7 including two of said card receiving means located on said protective coating.

* * * * *